US007025583B2

(12) United States Patent
Bald

(10) Patent No.: US 7,025,583 B2
(45) Date of Patent: Apr. 11, 2006

(54) COMPACTION DEVICE FOR COMPACTING MOULDED BODIES FROM GRANULAR SUBSTANCES AND METHOD FOR USING SAID DEVICE

(75) Inventor: Hubert Bald, Bad Berleburg (DE)

(73) Assignee: GEDIB Ingenieurburo und Innovationsberatung GmbH, Bad Berleburg (DE)

( * ) Notice: Subject to any disclaimer, the term of this patent is extended or adjusted under 35 U.S.C. 154(b) by 0 days.

(21) Appl. No.: 10/416,809

(22) PCT Filed: Jun. 19, 2001

(86) PCT No.: PCT/DE01/02266

§ 371 (c)(1),
(2), (4) Date: Oct. 29, 2003

(87) PCT Pub. No.: WO02/38346

PCT Pub. Date: May 16, 2002

(65) Prior Publication Data

US 2004/0051197 A1 Mar. 18, 2004

(30) Foreign Application Priority Data

| | | |
|---|---|---|
| Nov. 11, 2000 | (DE) | 100 56 063 |
| Nov. 12, 2000 | (DE) | 100 55 904 |
| Dec. 6, 2000 | (DE) | 100 60 860 |
| Feb. 13, 2001 | (DE) | 101 06 910 |

(51) Int. Cl.
*B28B 1/087* (2006.01)

(52) U.S. Cl. ..... 425/255; 425/421; 425/424; 425/432; 425/456

(58) Field of Classification Search ..... 425/421, 425/432, 406, 410, 456, DIG. 27, 253–255, 425/424–425
See application file for complete search history.

(56) References Cited

U.S. PATENT DOCUMENTS

| | | | | |
|---|---|---|---|---|
| 4,179,258 | A * | 12/1979 | Karas et al. | 425/421 |
| 4,193,754 | A * | 3/1980 | Sekiguchi | 425/424 |
| 4,725,220 | A * | 2/1988 | Percinel et al. | 425/432 |
| 4,830,597 | A * | 5/1989 | Steier et al. | 425/456 |
| 6,054,079 | A * | 4/2000 | Toet et al. | 425/421 |

FOREIGN PATENT DOCUMENTS

DE 278298 A * 5/1990

* cited by examiner

*Primary Examiner*—Duane Smith
*Assistant Examiner*—Thu Khanh T. Nguyen
(74) *Attorney, Agent, or Firm*—Alix, Yale & Ristas, LLP

(57) ABSTRACT

Apparatus and method for carrying out compaction operations on molded bodies that consist of granular materials and are placed on pallets, the compaction being achieved by impact of a vibrating table on the underside of the pallet. The vibrating table, together with a spring system forms a mass-spring system, which acts as a vibrator capable of oscillation that is excited by an excitation device to produce forced vibrations. The spring system, together with the system mass, is designed to develop at least one individual frequency within the range of the compaction frequency, whereby it is also possible to adjust the individual frequency gradually or continuously. This, together with the fact that the excitation frequency can be adjusted, allows the vibrator to be operated partially or completely in resonance mode over the whole frequency range of the compaction.

29 Claims, 4 Drawing Sheets

COMPACTION DEVICE FOR COMPACTING MOULDED BODIES FROM GRANULAR SUBSTANCES AND METHOD FOR USING SAID DEVICE

CROSS-REFERENCE TO RELATED APPLICATIONS

This is the national stage of International Application No. PCT/DE01/02266 filed Jun. 19, 2001 which claims priority from German Patent Application No. 100 56 063.6 Filed Nov. 11, 2000, German Patent Application No. 100 55 904.2 Filed Nov. 12, 2000, German Patent Application No. 100 60 860.4 Filed Dec. 6, 2000, and German Patent Application No. 101 06 910.3 Filed Feb. 13, 2001.

BACKGROUND OF THE INVENTION

The invention relates to a compacting device operated with vibration oscillations for molding and compacting molding materials in mold cavities of molding boxes to form molded bodies and to a method of using the compacting device, the molded bodies having an upper side and an underside, via which the compacting forces are introduced. In the case of this method, before the compacting operation, the molding material is located in the mold cavities initially as a volume mass of loosely coherent granular constituents, which are molded into solid molded bodies only during the compacting operation by the action of compacting forces on the upper side and underside. When the compacting device is used in machines for producing finished concrete products (for example paving blocks), the volume mass may consist for example of moist concrete mortar. In the case of the compacting devices operating with vibrators for producing finished concrete products, a distinction can be drawn between 3 known generic types, which are suitable for describing the prior art of interest here and which have in common the fact that the molding box and the molding material are arranged on the upper side of a pallet or a base plate during the compacting operation. In this case, during the main compaction a pressing plate which can be moved in the vertical direction by a pressing device and can be driven to exert a predetermined pressing pressure rests on the upper side of the molding material.

The first generic type concerns the popular "conventional type", known to a person skilled in the art, of impact compaction, in which the vibrating table of a vibrator, which can be regulated with respect to its oscillating stroke amplitude, strikes once against the pallet from below with every oscillating period. This generic type represents the closest prior art, described by EP 0 515 305 B1. It is also the case with the second generic type, the compacting device of which operates very differently than in the case of the first generic type, that the compacting energy originally generated by the vibrator is introduced into the molding material by means of impact processes. In this case, the pallet and the molding box are clamped to the vibrating table during the compacting operation, so that their masses are considered to belong to the mass of the oscillating system and oscillate along with it. The impact point, which can be defined by the colliding of different masses at different velocities, here lies on the upper side and underside of the molding material itself, an air gap being produced during the compaction between the underside of the molded body and the pallet on the one hand and the upper side of the molded body and the pressing plate on the other hand. This second generic type, described by DE 44 34 679 A1, can be described most accurately as a compacting device for carrying out a "shaking compaction". In the case of the third generic type, documented by EP 0 870 585 A1, the masses of the molding material, the molding box, the pallet and the vibrating table together form a system of masses which represents the oscillating mass of a mass-spring system operating with harmonic (sinusoidal) oscillating movements. The dynamic forces introduced on the upper side and underside of the molded body, which are derived from the oscillating accelerations of the co-oscillating masses, generate a likewise sinusoidally proceeding dynamic compaction pressure (harmonic compaction). Some particulars of interest here on the prior art according to EP 0 515 305 B1 and EP 0 870 585 A1 can also be found in an article in the specialist journal "BFT", September 2000 edition, pages 44–52, published by: Bauverlag GmbH, Am Klingenweg 4a, D-65396 Walluf.

All three generic types referred to are based on different philosophies concerning the physical effects occurring during compaction. Even seemingly slight differences in features of the physical effects used may be of significance here, such as for example the forming of one and the same static moment on unbalanced bodies of unbalance vibrators with greater or smaller center-to-center spacings, associated with smaller or greater masses. All three generic types share the common feature that it is endeavored when operating the compacting devices to operate the oscillating systems in such a way that highest possible compacting accelerations are achieved in the molding material with highest possible oscillating frequencies (as far as possible to about 70 Hz), it also being intended that the accelerations and frequencies can be set according to values which can be given. In any event, the oscillating acceleration of the vibrating table always involved, on which not only the result of compaction but also the loads on the components involved depend, is a linear function of the oscillating amplitude and a square function of the oscillating frequency.

The publication EP 0 515 305 B1 describes a directional vibrator which can be adjusted with respect to the oscillating stroke amplitude (amplitude decisive here for the compacting acceleration) and the oscillating frequency, with 4 unbalanced shafts of a compacting device of the first generic type. The 4 unbalanced shafts are driven by a driving and adjusting motor of their own in each case, by way of universal shafts. The adjustment of the phase angle defining the oscillating stroke amplitude takes place exclusively by means of motor torques to be correspondingly set, which generate a reactive power in the case of a phase angle deviating from the value 0° or 180° (as also described for example in DE 40 00 011 C2). The following features are to be mentioned as disadvantages of such an unbalance vibrator and compacting method:

The uppermost oscillating frequency is generally restricted in practice to 50 Hz because of the constant loading limit to be taken into consideration, the limit loading being reached in particular when there are rolling bearings of the unbalanced shafts and the articulated shafts are co-oscillating. In this respect, see also the article in the specialist journal cited above on page 45, middle section, and on page 47, middle section.

High power losses occur due to the reactive power to be constantly converted and due to the high bearing friction energy levels generated when there are high centrifugal forces. Since the high power losses also have to be converted in the drive motors of the unbalanced shafts, the motors and their activating devices are dimensioned unnecessarily large with respect to the compacting power alone.

As a result of the masses of inertia to be overcome of the motors and unbalanced bodies and as a result of the fact that changing of the phase angle is also always accompanied at the same time by changing of the reactive power torque, likewise to be corrected along with it, the values of the phase angles given as a controlled variable (static moment) can only be regulated with rough tolerances by the electronic closed-loop control (or else by alternative mechanical controls), which leads to corresponding unevennesses of the oscillating stroke profile of the vibrating table during the compacting operation, proceeding over many oscillating periods, and consequently, to poor reproducibility of the compacting quality. Added to this here is the disadvantage that the rough tolerances of the "phase angle" controlled variable affect the relative angular position of a total of 4 unbalanced bodies, which usually lie with their axes of rotation in one plane and the arrangement of which extends over a large part of the longitudinal extent of the vibrating table. The dissimilarities of the relative angular positions leads to dissimilar accelerations with respect to the overall table surface. This leads in turn to dissimilar compacting results at different locations of the table surface.

The oscillating stroke amplitude of the vibrating table, decisive for the compacting effect, can be regulated only indirectly and sluggishly by means of the adjustable phase angle.

Apart from the masses of inertia, the regulating of the phase angle is made more difficult in principle by the fact that, when the vibrating table strikes against the pallet, the rotational velocity of the unbalanced shafts always experiences an abrupt change, the changes in velocity, and consequently angle of rotation, taking different values because of the relative position of the unbalanced bodies during the impact, dependent on the phase angle.

The regulating of the phase angle takes place by the rotational velocity of the unbalanced shafts being regulated in relation to one another. This means that simultaneous regulating of the phase angle and oscillating frequency cannot be achieved simultaneously in practice and can only be achieved with difficulty.

It is desired to be able to use a method in which, during the operation of main compaction, a given range of the compacting frequency up to highest frequencies is passed through with given values for the oscillating stroke amplitude of the vibrating table. In the case of this method, the micro-oscillating systems contained in the molding material and defined by the different grain sizes can be excited with different natural frequencies to produce resonance effects, whereby the compaction is improved. It must be possible in this case for the passing through of the frequency range to be carried out in about 3 seconds. In the case of the prior art, the implementation of this method is hindered by the limitation of the oscillation frequencies of the vibrating table and by the poor simultaneous controllability of the oscillating frequency and oscillating stroke amplitude.

The present invention is not suggested by the publications mentioned, DE 44 34 679 A1 or EP 0 870 585 A1, if only because they describe compacting devices which operate in a quite different way (shaking compaction and harmonic compaction, respectively) with different compacting mechanisms. The spring system of the vibrating table described in DE 44 34 679 cannot serve as a model insofar as a force transfer by the springs in both directions of oscillation is envisaged, since in the case of the spring system described spring elements 116 which operate simulataneously as compression springs and tension springs are provided. This means stress loading of the springs that is twice as high in comparison with a type of construction in which springs are only loaded by compression. What is more, the force connection of a spring loaded by compression and tension at its ends to a frame (or the foundation) of the compacting device on the one hand and to the vibrating table on the other hand is very problematical and cannot be sustained in the long term with a highly dynamic mode of operation envisaged here. The hydraulic exciter actuators shown in DE 44 34 679 must at the same time also undertake the function of a linear guide of the vibrating table. Since, with impact operation under the pallet, the vibrating table tends toward constantly changing inclined positions, this means high mechanical loading of the exciter actuators by the function allocated to them of linear guidance, which is further increased by the tendency toward jamming occurring in this case when there are two linear guides present.

The compacting device described by the publication EP 0 870 585 also cannot act as a model with respect to the following functions: the hydraulically designed system spring is able to execute a spring action only in the case of a downwardly directed oscillating movement and the use of the same fluid medium for the hydraulic exciter and for the hydraulic spring demonstrably leads to considerable energy losses also when executing the spring function. As disclosed by column 2, lines 25 to 30, the spring constant is evidently to be variable only for the purpose of adapting the compacting method to the masses of different sizes occurring in the case of products to be differently compacted, in order to re-establish the natural frequency of the mass-spring system, given as a fixed value. Changing of the natural frequency during the compacting operation is not envisaged.

SUMMARY OF THE INVENTION

It is the object of the invention to eliminate or reduce the disadvantages described above of the prior art, in which the compaction energy is introduced into the molded body predominantly by instances of impact of the vibrating table from below against the pallet. It is intended here for high impact frequencies to be used and for the compacting device to be able to operate with a compacting frequency that can be adjusted in a wide range (even during the compacting operation) up to highest frequencies of 75 Hz and higher, with a long service life of the components involved and with low energy expenditure. At the same time, it is also intended to use the means of the invention to improve the repeating accuracy of generating the compacting acceleration by the instances of impact on the pallet or on the underside of the molded body itself and the uniformity of the distribution of the compacting acceleration over the entire surface area of the pallet.

The invention uses, inter alia, the following principle: when conventionally generating the oscillating movement of the vibrating table by using springs which serve only for isolating oscillation and are therefore set soft, the accelerating forces which have to be applied to the oscillating masses are generated overwhelmingly by directed centrifugal forces of the unbalanced bodies. When generating the oscillating movements according to the invention, the accelerating forces are applied predominantly by spring forces and only to a smaller extent by the exciter forces of the exciter device, at least in that case in which they have to reach the highest values at the highest oscillating frequencies. This is achieved by using the effect of resonance amplification. In a further development of the invention, this effect is utilized even better by the fact that it is envisaged to allow not only the natural frequency lying in the range of the highest oscillating frequencies but also at least a second natural frequency of the mass-spring system to be produced in the range of the oscillating frequencies to be operationally covered. As shown in FIG. 6, this has the effect that the necessary exciter forces can be reduced still further, which, inter alia, also facilitates the use of AC linear motors commonly available on the market and likewise also the possibility of varying the compaction frequency over a wide frequency range during a compacting operation.

For storing the kinetic energy of the system mass taken along in the upward oscillating movement of the vibrating table, there can also be incorporated in the spring system spring elements whose spring force acts on the pallet from above, which also includes those spring forces which are concomitantly applied via the pressing plate. Insofar as this concerns those spring forces which are not passed via the pressing plate, as is the case for example with the springs 124 in FIG. 1, these contribute to allowing the oscillating stroke amplitude of the vibrating table or the mold also to be regulated according to given values when the compacting system is oscillating idly or during pre-compaction. The spring elements of the system spring storing the kinetic energy have to store a much higher amount of energy in comparison with the soft-set isolating springs in the case of the conventional compacting systems. Not only in the interests of their service life (risk of self-destruction by heat) but also for the purpose of avoiding unnecessary energy losses, the spring elements of the system spring are therefore preferably produced from steel or from a low-damping elastomer material or are embodied by an (intrinsically low-damping) liquid compressible medium.

The use of unbalance vibrators that can be adjusted with respect to their static moment as exciter actuators is entirely appropriate within the scope of the invention, since, even in the case of higher exciter frequencies than can be conventionally attained, the static moment determining all the properties of the vibrator of interest here can be kept lower than in the case of oscillating excitation just by the centrifugal forces of an unbalance vibrator, because of the use of resonance amplification. This means: smaller bearing forces of the unbalanced shafts, with smaller bearing forces in turn meaning that anti-friction bearings with higher permissible limiting rotational speeds can be used. Smaller moments of inertia of the unbalanced bodies themselves and of the drive motors of the unbalances, smaller moments of inertia improving the controllability of the phase angle. Smaller bearing friction energy losses and smaller reactive power levels, the reactive power levels being dependent on the square of the magnitude of the static moment. Possible closer arrangement of the unbalanced shafts, this feature leading to smaller unevennesses in the acceleration of the vibrating table as a result of incorrect rotational positions of the unbalanced bodies, because of the improved central application of the centrifugal forces.

The following definitions apply to the terms "hard" and "soft" springs used in connection with the spring system: a soft spring is used for isolating the accelerating effect of oscillating masses. The value of the "amplification function" $\phi$ (for example represented in the diagram 6.3-5 on page 300 of "Physikhutte, Band 1" [physics works, volume 1], 29th edition, published by Wilhelm Ernst & Sohn, Berlin, Munich, Dusseldorf), which can be calculated according to a known formula, must be $\phi \leqq 1$ in the case of soft springs. This value is reached when the ratio becomes $\eta = f_E/f_N \geqq 1.41$ where $f_E$ designates the exciter frequency and $f_N$ designates the natural frequency. For a reasonable isolation, however, at least a value of $\eta = f_E/f_N 2$ is generally required. In other words: the exciter frequency $f_E$ (=compacting frequency) must always lie between the value $f_E=0$ and the value $f_E=1.41*f_N$, optimally in the range $f_E=f_N$, in the case of a spring set hard for the purpose of using the resonance effect. In the case of a spring set soft for the purpose of isolation, the exciter frequency $f_E$ must always have a value of $f_E$=greater than $2*f_N$. A hard-set system spring means in the case of the present invention that the effect of the amplification function $\phi$ is to be utilized for values $\phi>1$. Any statement in the claims that the system spring is set hard, at least for the downwardly directed oscillating movement, means that a system spring can also be constructed in such a way that different spring constants are effective in the two directions of oscillation. An example of hard- and soft-set springs: according to a known relationship $q=248.5/f_N^2$ and q (in mm), the spring deflection q of a mass mounted on a spring can be determined with the natural frequency $f_N$ (in Hz) under its own weight. If the natural frequency in the case of a "hard" system spring is at least 30 Hz (or higher), the spring deflection q under the system mass can be calculated as: q=0.27 mm (or less). Should the isolating springs be correctly chosen in the case of a lowest permissible exciter frequency of a compacting device with soft-designed isolating springs, the natural frequency that can be achieved with their spring constant should be at most 15 Hz. In this case, the value would be q=1.1 mm.

The envisaged possibility of regulating the amplitude of the oscillating stroke s of the vibrating table reverts to the practice tried and tested in the prior art of influencing this physical variable by regulating the phase angle in the sense of influencing the compaction intensity. In this case, the value of the oscillating stroke amplitude s, which in physical terms is the actual measure of the compaction intensity actually to be regulated, is also determined indirectly by the phase angle. The determination of the phase angle, which is defined by the relative angular position of rotating unbalanced bodies, by using measuring instruments is complex and affected by noticeable measuring errors. Unlike in the case of the prior art, in the case of the invention however, when linear motors are used as the exciter actuators, the value of the oscillating stroke amplitude s is not influenced indirectly by way of another variable to be regulated but is regulated directly (and measured directly), which, together with the fact that a changing reactive power torque does not also have to be regulated at the same time, leads to more accurate controllability of the compaction intensity. If hydraulic or electrical linear motors are used, they can be subjected to forces in such a way that, even if a number of linear motors with a parallel effect are used, the development of the force takes place precisely symmetrically, so that unsymmetrical accelerations do not occur at the vibrating table just because of their multiple arrangement.

It is desirable that, when influencing the value of the oscillating stroke amplitude s, the oscillating frequency can also be changed at the same time in a way which can be given. This object is made possible in the case of the present invention by the good controllability of the oscillating stroke amplitude s in combination with the possibility provided in the case of the invention that a rotating velocity does not have to be changed, but only a repetition frequency in the apportioning of specific amounts of exciter energy per oscillating period, which in the case of hydraulic linear motors can take place with very little inertia and in the case of electrical linear motors can take place with virtually no inertia.

The use of electrical (three-phase AC) linear motors is very advantageous, since they represent a "cleaner" solution, operating with low energy losses. However, the electrical linear motors commonly available on the market cannot readily be used for the intended task, since, with their activating devices produced as standard, they are intended for carrying out linear movements with a given stroke profile and velocity profile, and at the same time automatically generate those forces which are required for the acceleration of the moved masses or those for overcoming the forces opposing the linear displacement (usually machining forces). The typical application for linear motors of this type is in the case of machine tools. The activating devices normally available for purchase must therefore be substituted by a special activating device. The most important differences in the use of the linear motors in the case of the invention in comparison with the conventional tasks are comprised by the following features: in the case of the compacting device, the acceleration and deceleration of the oscillating masses, including the mass of the co-oscillating motor part of the linear motor, are determined overwhelmingly by the forces of the system spring (in resonance operation), in particular when the exciter frequencies are close to the natural frequencies. Therefore, a regulating device customary in the case of the linear motors could not be used for generating a programmed movement sequence, if only because it does not know and cannot influence the spring forces and because the motor forces alone are not adequate by any means for the accelerations to be generated.

In the case of the object set in the case of the invention, on the other hand, for each oscillating period (once the oscillation has been initiated) the linear motor in principle only has to pass on to the system mass those amounts of energy that are extracted from the oscillating system mass by friction or by the compaction energy delivered upon impact. Consequently, what is important in the case of an oscillating stroke amplitude to be kept constant is to resupply that portion of energy which is required to maintain the given oscillating stroke amplitude for every oscillating period of the oscillating system mass. The force development at the linear motor in this case also does not have to follow in its magnitude a time function determined by the oscillating time (for example square or sinusoidal function), since only the portion of energy transferred (per period) is decisive, the points in time for the beginning and end of the force development of course likewise playing a role and having to be fixed by the controller. The activating device must also be capable of taking into consideration the phenomenon of the occurrence of a phase shifting angle $\gamma$ and the change in its value occurring automatically as the compacting operation progresses (the phase shifting angle $\gamma$ defines the angular amount by which the oscillating stroke amplitude lags behind the exciter force amplitude), which moreover also applies to the controller influencing a hydraulic linear motor. Since the point in time of measuring the physical variable to be regulated s, s', s" or f, f', f", and the point in time of converting the value derived from it by a control algorithm for the manipulated variable y (for fixing the magnitude of the next portion of energy to be transferred) is not identical, measured values and/or derived values must be buffer-stored for a short time.

It is advantageous not to limit the vibrating table in its three-dimensional freedom of movement exclusively by the system spring, but to guide the vibrating table in a straight manner by a single central linear guide to enforce a co-directed acceleration of all the parts of said vibrating table. In this case, the linear guide, which is optimally a cylindrical guide, has to absorb all the horizontal acceleration forces which may be produced for example by the impact. If an electrical linear motor is used, it is possible to dispense with such a linear guide if the air gap present in the motors between the fixed part and the movable part is also able to accommodate the horizontal deviations of the vibrating table. If a hydraulic linear motor is used and hydraulic cylinders of a customary type of construction are used, however, a linear guide should not be dispensed with, unless the hydraulic cylinders and linear guide are integrated in one structural unit by corresponding design measures. A linear guide not only has the advantage that it provides a uniform distribution of the impact accelerations, but also has the consequence of reducing mold wear.

The particular advantages of the invention can be summarized as follows: elimination or reduction of the disadvantages mentioned of the unbalance vibrators that can be regulated with respect to the oscillating stroke amplitude, combined with an increase in the quality of the compaction process brought about by greater reproducibility of the result when converting the kinetic oscillating energy into compaction energy. High achievable oscillating frequencies. Lower necessary exciter power. Specifically when using linear motors as exciter actuators, the exciter energy is converted into compaction energy in a direct way and energy is saved by doing away with the reactive power levels and the bearing friction energy. Continuous rapid adjustability of the compacting frequency along with simultaneous regulating of the oscillating stroke amplitudes.

Particular advantages are obtained when an electrical linear motor is used instead of a hydraulic linear motor by the following features: the electrical linear motors operate with virtually no wear. The development of the exciter forces can be carried out with particular low inertia, for which reason these linear motors can also be regulated more dynamically and more accurately. The force profile does not have to be sinusoidal, as virtually dictated by the use of servo-valves in the case of the hydraulic linear motor. When the vibrating table strikes against the pallet, high damaging pressure peaks occur in the case of a hydraulic linear motor. The electrical linear motor has an advantage in this respect, because the sudden changes in force are effective in the elastic field of the air gap and because electrical surge voltages can be absorbed by electrical means.

BRIEF DESCRIPTION OF THE DRAWINGS

The invention is explained in more detail on the basis of 6 drawings.

DETAILED DESCRIPTION OF THE PREFERRED EMBODIMENT

Figure 1:
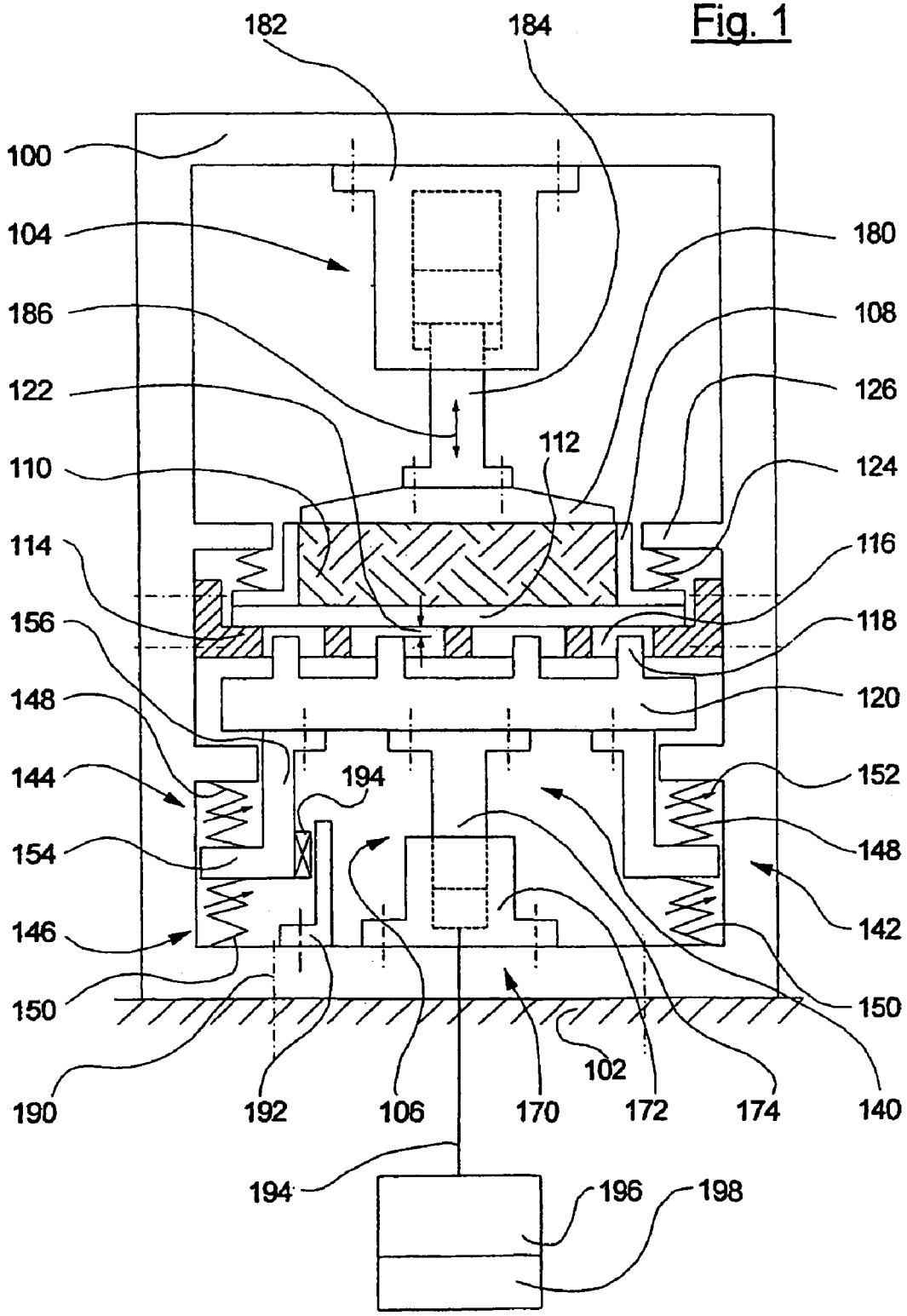
FIG. 1 shows in a schematic way a compacting device of the first generic type, in which the vibrating table strikes once against the pallet from below with every oscillating period.

In FIG. 1, 100 is the frame of the compacting device, which stands on the foundation 102 and by which the forces to be transferred from the pressing device 104 and from the exciter device 106 are supported against one another. The frame may in this case be firmly connected to the foundation, which is symbolically represented by the lines 190, although in the case of a small mass of the frame considerable exciter forces have to be transferred to the foundation. The molded body 110 enclosed in the mold cavity of the molding box 108 lies with its underside on a pallet 112. The pallet itself rests on a baffle bar 114, which is fastened to the frame 100 (and for the sake of clarity identified by shading) and which is provided with clearances 116, through which the impact bars 118 of the vibrating table 120 can reach and, in the oscillating movement of the vibrating table, strike against the underside of the pallet after overcoming the air gap 122. The molding box 108 resting on the pallet is pressed firmly onto the upper side of the pallet 112 by means of springs 124, which are supported against the frame by means of lugs 126. In this way, the molding box retains a firm connection to the pallet even in the case in which the pallet is pushed upward by the impact bars 118 and may thereby lift off from the baffle bar 114. The molding box could, however, also be firmly braced to the pallet (by a clamping device not shown). The vibrating table 120 forms with its mass the main component of the system mass of the oscillatory mass-spring system 140, the oscillating forces of which are a absorbed or generated primarily by the associated system spring 142.

The system spring comprises an upper spring system 144, by which at least part of the kinetic energy taken along as a maximum in the upward oscillating movement is stored, and a lower spring system 146, by which the main component of the kinetic energy taken along as a maximum in the downward oscillating movement is stored. The upper spring system 144 and the lower spring system 146 respectively comprise a number of spring elements 148 and 150, which may also be changeable or adjustable with respect to their spring constant, which is symbolically indicated by the arrows 152. The spring elements 148 and 150 may be designed as compression springs, thrust springs, torsion springs or spiral springs and, in the case of FIG. 1, are braced against one another in such a way that they still have a residual spring deformation even in the case of the greatest oscillating amplitudes of the system mass which are to be carried out. The forces of the spring elements 148 and 150 are restrained at the one ends between parts of the frame 100 and supported at the other ends against a force connecting part 154, which is part of a force transferring part 156, by which the forces of the upper and lower spring systems are transferred to the system mass. It is advantageous to transfer the forces of the spring elements of the spring system into the force connecting parts by compressive forces and/or shearing forces, at least at those ends at which the forces of the springs are transferred into the system mass, since these points are critical points with respect to operating reliability and durability, which quickly fail if the spring elements are connected to the force connecting parts with predominant application of tensile forces at this point.

The exciter device 106 comprises an exciter actuator 170, comprising a fixed actuator part 172 connected to the frame 100, a movable actuator part 174 connected to the system mass, and an activating device 196, which also includes a controller 198. With the aid of the activating device, the energy transfer means (electric current or hydraulic volumetric flow) are formed or controlled in such a way that, with application by the movable actuator part 174 of a constant or variable exciter frequency which can be given, exciter forces and consequently portions of exciter energy can be transferred to the mass-spring system with every half-period or full period of the oscillation, whereby said system is forced to carry out oscillations and to deliver impact energy for the compacting operation. Depending on the size of the air gap 122 set (which can also be set to the value zero or a negative value), the oscillating stroke amplitudes A are in this case to be generated with such a magnitude that adequate impact energy for the compaction taking place in a way known per se can be transferred. It is preferable to be possible for the physical oscillating variable defining the transferable compaction energy, for example the oscillating stroke amplitude A, to be controlled or regulated, to be precise also with the oscillating frequency kept constant.

The pressing device 104 comprises a fixed part 182, a movable part 184, to which the pressing plate 180 is connected, and a control part (not represented in the drawing) for carrying out a vertical adjusting movement of the pressing plate, indicated by the arrow 186. The parts of the frame 100 absorbing the forces of the upper and lower spring systems, together with the parts of the frame absorbing the forces of the exciter device 106, may also have been separate from the frame 100 and arranged together on a special foundation part (not represented in the drawing) which is separate from the foundation 102, which foundation part in this case (serving as a damping mass) would preferably have to be supported against the foundation 102 by means of isolating springs (not represented in the drawing) The exciter device 106 with its exciter actuator 170, of which it is required that, together with an activating device, it must be capable of transferring variable amounts of energy into the oscillating system even with the exciter frequency kept constant, may be configured in different variants. The exciter actuator may be a directional unbalance vibrator that can be regulated with respect to the static moment or a linear motor operated hydraulically or electrically with respect to the convertible portions of exciter energy. Provided for measuring the oscillating stroke amplitude A to be regulated is a measuring device, which comprises a part 192 firmly connected to the frame and a part 194 connected to the vibrating table. The signal of the variable measured is fed to the controller 198 for processing (not shown in the drawing).

Provided in the upper spring system 144 and/or in the lower spring system 146 are hydraulic or mechanical springs, the spring constants of which are in the simplest case constant and which produce a resulting system spring, the natural frequency of which can be positioned at a specific point, for example in the middle of the frequency range of the exciter frequency, whereby a point of resonance is formed at this point. Although the resonance effect of the amplitude amplification to be utilized according to the invention is at the greatest at the point of resonance, the resonance effect is also to be used above and/or below the point of resonance, to a degree then unavoidably lessened according to the resonance curve (in the case of the possibility also provided according to the invention of the exciter frequency passing continuously through a given frequency range). As a result of the resonance effect, the oscillating acceleration of the system mass takes place predominantly with the co-operation of the spring forces or with the co-operation of the amounts of energy stored in the springs. This has the advantage that these forces and the amounts of energy to be assigned to them no longer have to be generated by the exciter device, which has considerable effects on the overall size of the exciter device and on the magnitude of the energy loss converted in the latter. In the ideal case of the exciter frequency and natural frequency being identical, the exciter device then only has to convert the energy loss extracted from the oscillating system by its frictional losses and the energy loss extracted from the oscillating system as compaction energy.

It is evident that it must be of great advantage if each exciter frequency within the frequency range of the adjustable exciter frequency could be assigned a natural frequency of the system spring. This ideal solution is to be achieved according to the invention by a continuously adjustable natural frequency of the system spring, the adjustment of the exciter frequency $f_E$ simultaneously allowing the natural frequency $f_N$ to be adjusted along with it, while maintaining any desired value for $\eta=f_E/f_N$. Alternatively, instead of a continuously adjustable natural frequency, a step-by-step adjustment of the natural frequency could also come into consideration, with lower outlay.

The spring constant of the system spring is always to be understood as a resulting spring constant $C_R$, which is produced by the spring constant of all the spring elements involved in the system spring. The resulting spring constant $C_R$ can be defined by the fact that, together with the system mass, it determines the resulting natural frequency. With step-by-step changing of the resulting spring constant (during the idle time or during the compaction), it may be provided for example that one or more springs are always fully used or switched on and that, step by step, other springs are additionally brought into the force transfer of the oscillating forces to supplement these constantly switched-on springs. This may take place, for example, by springs of different spring constants being additionally connected in such a way that their deformation stroke coincides completely with the oscillating stroke of the system mass, or else in such a way that their deformation stroke makes up only a predeterminable and settable component of the oscillating stroke of the system mass. In the latter case, this is an adjustment of the "progression" of the spring characteristic of the resulting spring constant. If a system spring which can be adjusted step-by-step or operates with variable progression is used, it is also intended according to the invention to be possible to smooth again or correct the changing of the physical variables of the oscillating system brought about by the changes of the resulting spring constant (for example oscillating stroke amplitude A) with the aid of an activating device especially equipped for this purpose for the exciter device by means of the influencing parameters of the exciter energy to be supplied or removed, in the sense of keeping the physical variables constant. A spring that can be connected and disconnected is explained in more detail in FIG. 3.

Insofar as the lower or upper spring system is configured as a spring system that is adjustable with respect to its resulting spring constant, and the resulting spring constant of the lower or upper spring system is determined by at least one non-adjustable spring and at least one adjustable spring that can be additionally connected, a reduction in the outlay can be achieved by the adjusting range of the natural frequency only beginning as from a specific frequency upward. This is adequate for practical requirements, where for example an adjusting range of the natural frequency can be provided for instance from 30 Hz to 75 Hz.

An adjustable mechanical spring element is described below in FIG. 2. An adjustable hydraulic spring element can be created by a spring element of the system spring being embodied by a volume of compressible pressure fluid (hydraulic oil) at least partially confined in a cylinder body by a spring piston and by the spring rate being changeable by changing the size of the pressure fluid volume, either by the size of the pressure fluid volume being formed by a number of subvolumes which can be separated from one another by switchable shut-off valves, or by part of the pressure fluid volume being confined in a cylinder of which the cylinder chamber can be changed by a piston which is displaceable in the cylinder in a given way and preferably continuously, the displacement of the piston being carried out for example by a threaded spindle drive.

Figure 2:
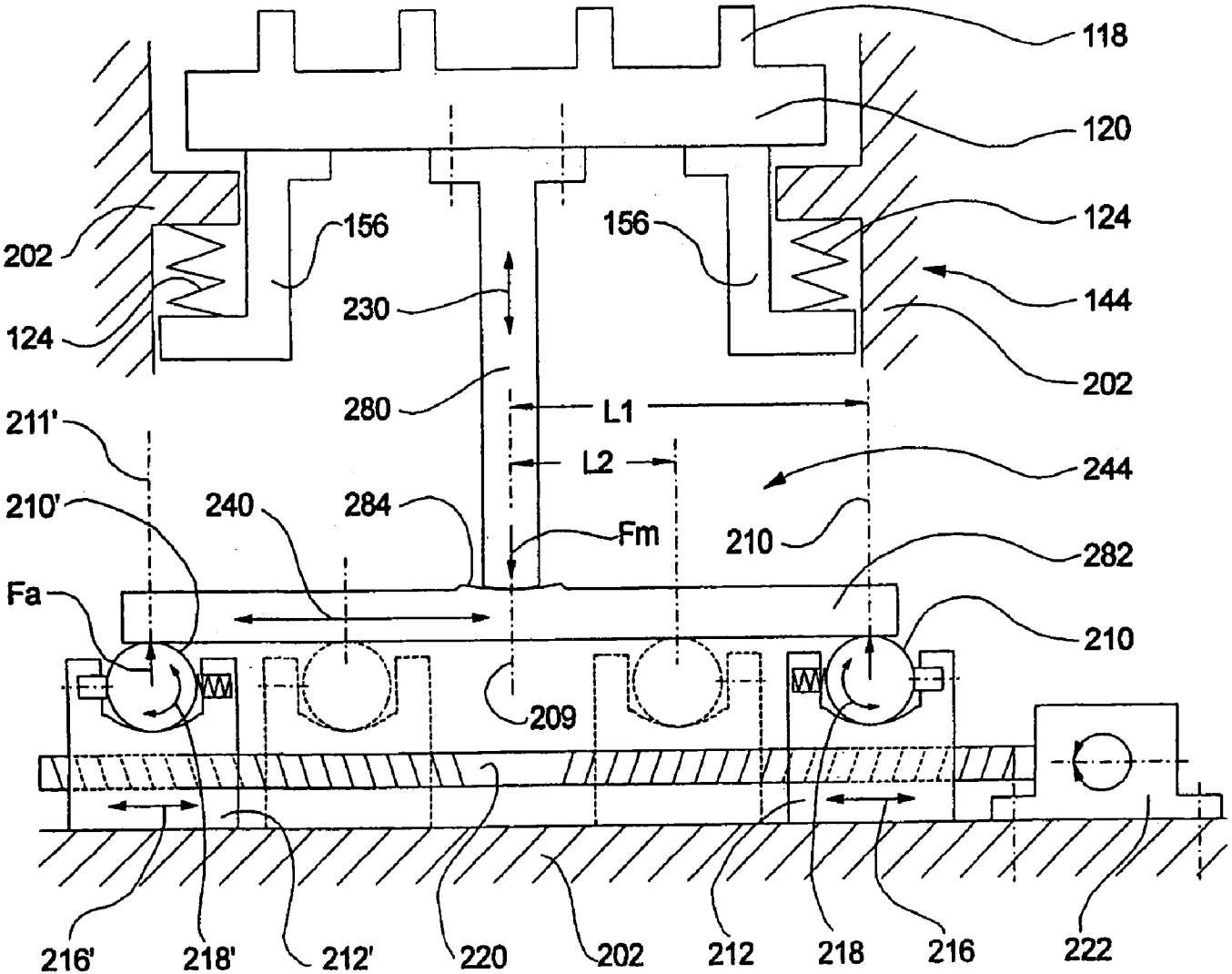
In FIG. 2, the same vibrating table as in FIG. 1 is shown in the upper part of the drawing, but connected to a different system spring, the lower spring system shown in FIG. 1 having been exchanged for a spring system that is adjustable with respect to the spring constant and has a single leaf spring as the resilient element.

FIG. 2 shows a variant of the oscillatory mass-spring system represented in principle in FIG. 1, with the system mass and with the system spring, of a different type here. An exciter device has not been represented for the sake of simplicity and could be imagined in the form of two linear motors serving as exciter actuators, acting additionally on the vibrating table 120. In the upper part of FIG. 2, the components with reference numerals beginning with the numeral 1 are identical to the components of the same name in FIG. 1. The connecting bodies 202, transferring the oscillating forces, could be identical to the frame 100 shown in FIG. 1. The system spring has in this case an upper spring system 144, comprising compression springs 124, and a lower spring system 244, which has a leaf spring 282, which can be adjusted with respect to its spring constant and is predominantly subjected to bending. The dynamic mass forces (or spring forces) to be exchanged between the leaf spring 282 of the lower spring system and the vibrating table 120 in the case of an oscillation of the system mass in the direction of the double-headed arrow 230 when there is a downward oscillating movement are passed via the oscillating-force stamp 280, which is fastened at the top to the vibrating table 120 and has at the lower end a rounding, by which it fits snugly in the rounding 284 of the leaf spring, the lower end acting as a force-introducing element of the first type, by which the mass force Fm is introduced centrally into the leaf spring, with the exclusive generation of compressive forces at the point of force introduction 209. A prestressing (preferably provided) on the springs 124 and on the leaf spring 282, preferably still existing in the case of the greatest oscillating stroke amplitudes A, ensures that the contact between the oscillating-force stamp 280 and the leaf spring 282 is never lost. The mass forces Fm acting on the leaf spring during the dynamic loading of the latter are transferred half and half to the force-introducing elements of the second type-210, 210', in the form of rollers, arranged at equal intervals L1 underneath the leaf spring at the points of force introduction 211, 211', with exclusive generation of compressive forces as supporting forces Fa.

The main direction of extent of the leaf spring is symbolized by the double-headed arrow 240. The force-introducing elements of the second type 210, 210', in the form of rollers, are mounted in roller carriers 212 and 212'. The double-headed arrows 216 and 216' indicate that the roller carriers can be displaced in both directions and, what is more, also under the pulsed loading by the supporting forces Fa. During their displacement, it is also allowed for the force-introducing elements of the second type 210 and 210' to rotate, which is indicated by the double-headed arrows 218, 218'.

The displacement of the roller carriers 212 and 212' in respectively opposed directions is performed synchronously, which is brought about by a threaded spindle 220 with a counter-running thread. The threaded spindle 220 is driven by a motor-operated drive unit 222, which for its part is controlled by a controller (not represented). By means of the controller and the drive unit 222, the roller carriers 212, 212', and consequently the points of introduction of the second type 211, 211' for the supporting forces Fa, can be brought into any desired predeterminable positions, in order for example to produce the distances L1 or L2. The roller carriers brought into the positions L2 are indicated by dashed lines. The distances L1 and L2 relate to the point of introduction of the first type 209. It is evident that the positions that can be set as desired for the points of introduction of the second type 211, 211' are accompanied (within certain limits) by spring constants which can be set as desired and continuously of the leaf spring.

Figure 3:
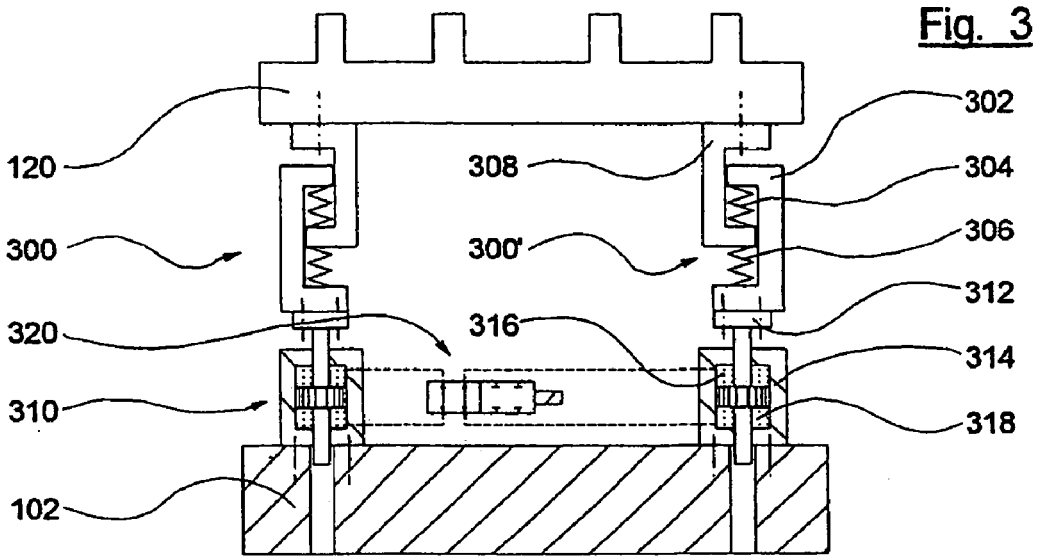
FIG. 3 shows details of another variant of the compacting device according to FIG. 1, comprising additional spring elements which can be connected and disconnected.

FIG. 3 shows a variation of the compacting device according to FIG. 1, two identical additional spring systems 300 and 300', with additional spring elements which can be additionally connected and disconnected and are arranged in a force transferring manner between the vibrating table 120 and the foundation 102, being represented. In a force transferring part of the second type 302, two spring elements 304 and 306, designed as compression springs and under compressive stress even in the disconnected state, are arranged in such a way that they transfer their spring forces to a lower bracket part of a force transferring part of the first type 308. The force transferring part of the first type is firmly connected to the vibrating table by means of an upper bracket part and intended for the purpose of transferring the resulting force, produced when the spring elements deform, to the vibrating table. The force transferring part of the second type 302 is firmly connected to a piston 312 of a hydraulic switching device 310, making it able, depending on the switching state of the switching device, to transfer or not transfer the resulting force produced when the spring elements deform to the foundation 102 via the cylinder 314 firmly connected to the foundation. In the case of a first switching state, the piston 312 can be moved up and down in the cylinder 314, virtually without transferring a force as this happens, or, in the case of a second switching state, be firmly restrained in the cylinder by the fluid medium. The switching states of the switching device 310 are determined by the position of the valve 320. In the position represented, the cylinder chambers 316 and 318 of the cylinder 314 are connected via the valve, so that the piston can move up and down in the cylinder without constraining forces. In the case of a second position of the valve, the cylinder chambers are closed, so that the force of the force transferring part of the second type 302 is transferred directly to the foundation.

Figure 4:
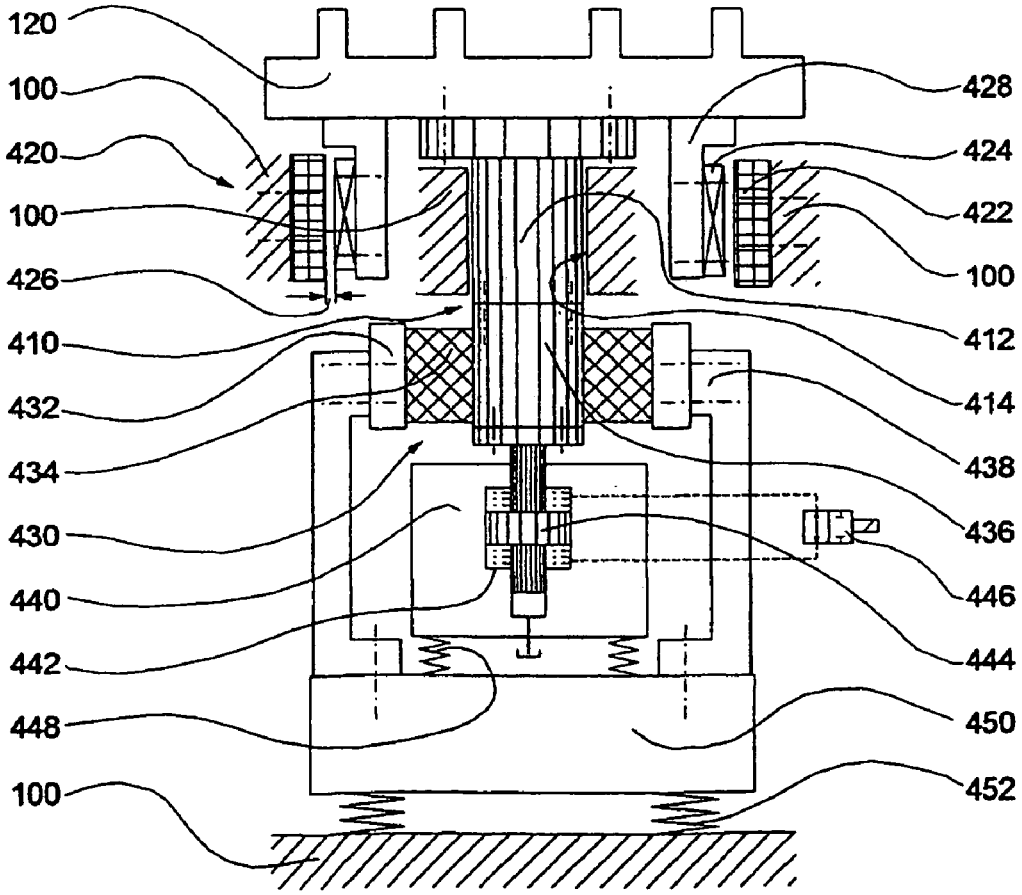
In FIG. 4, other possibilities for the development of a compacting device according to FIG. 1 are represented.

In FIG. 4, other possibilities for the development of the invention are represented, it being possible for the different functions to be arranged in the compacting device according to FIG. 1 and thereby connected on the one hand to the vibrating table 120 and on the other hand to the frame 100 (or the foundation 102).

The vibrating table 120 is firmly connected to a central guiding cylinder 412, the center axis of which runs through the center of gravity of the vibrating table and which is freely movable with its outer cylinder in the inner cylinder of a cylinder sliding guide 414. This forms a linear guide 410, which represents a constrained guidance of the vibrating table for executing the oscillating movement in a straight line only in a double direction with a guide part arranged centrally and mirror-symmetrically on the vibrating table. Provided as exciter actuators are two identical linear motors 420, which can be acted on by a special activating device (not represented), so that they generate exciter forces in the vertical direction. Each linear motor 420 comprises a fixed motor part 422 and a movable motor part 424, the two of which are separated by an air gap 426. The movable motor part 424 is firmly connected to the vibrating table 120 by means of a carrier part 428, while the fixed motor part 422 is fastened directly to the frame 100. The linear motors 420, preferably designed as three-phase AC motors, are activated by means of the special activating device in such a way that a physical variable of the oscillating profile of the vibrating table 120 or the mold 108. (in FIG. 1) is controlled or regulated according to given values, and so indirectly is also the course of the compacting operation.

430 reproduces a spring system, which represents the system spring at least in the case of the pre-compaction, if appropriate together with the spring elements 124 shown in FIG. 1. This system spring in this case develops with its special thrust spring 434, produced from an elastomer material, spring forces in two directions for the storage of amounts of kinetic energy taken along by the system mass in both directions of oscillation. The thrust spring 434, configured in this case as a hollow cylinder, is connected on the outside to a spring ring 432 and on the inside to a cylinder 436, which latter is fastened to the guide cylinder 412. The spring ring 432 is supported in terms of force firmly against the damping mass 450 by means of two holders 438, although the supporting could also be performed against the foundation 102 or the frame 100. It is evident from the arrangement of the spring system 430 that it can also undertake at the same time the task of the linear guide 410. In other words: a spring system with thrust springs which can develop spring forces in both directions of oscillation may also be provided simultaneously as a linear guide and perform the function of constrained guidance for executing the oscillating movement of the vibrating table in a double direction, insofar as the spring forces are transferred by a guide part arranged centrally on the vibrating table.

440 designates an additional mass that can be additionally connected and disconnected, by which the magnitude of the system mass can be changed, in order to be able in this way to change the natural frequency of the mass-spring system. Accommodated within the additional mass is a hydraulic cylinder 442, located in which is a piston 444, which is firmly connected to the cylinder 436 and consequently to the system mass. Formed by the piston in the hydraulic cylinder 442 are two displacement chambers, which can be individually shut off or connected to each other by means of a switchable valve 446. In the case in which the displacement chambers are connected to each other, the piston 444 can move freely up and down in the cylinder 442, without the additional mass being moved along with it as it does so. If the displacement chambers are individually shut off, the additional mass 440 is forced to co-oscillate synchronously with the system mass. In this case, the springs 448 will transfer only small forces to the damping mass (or the foundation), since they are designed as soft springs, which merely have to keep the additional mass at a specific height when it is not co-oscillating. Unlike in FIG. 1, where the system spring 142 is supported in terms of force against the frame 100, in FIG. 4 the system spring 430 is supported against a special damping mass 450, which for its part is again supported by means of soft-set springs 452 against the frame 100 or the foundation 102. This measure achieves the effect that the oscillating forces derived from the system spring 432, which for example in the case of a system mass of 1000 kg and an oscillating stroke amplitude of 1 mm at 70 Hz could reach peak values of about 20 tonnes, can only enter the foundation to a reduced extent, depending on the dimensioning of the additional mass.

Figure 5:
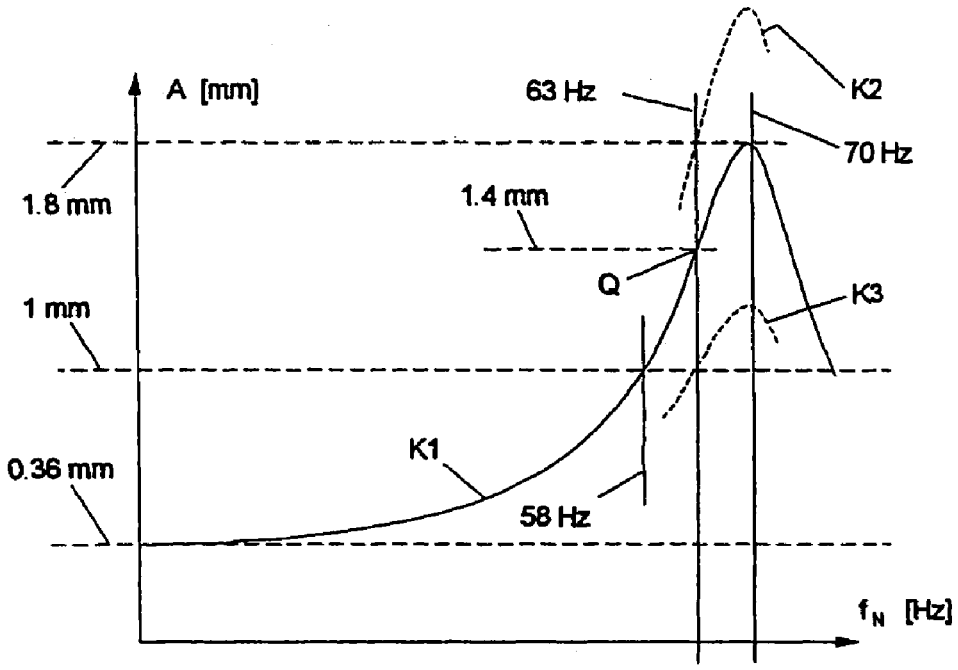
FIG. 5 shows a diagram with the profile of the oscillating stroke amplitude A over the exciter frequency $f_N$ of the system mass of a compacting device according to the invention with a single natural frequency, to explain possible amplitude regulating regimes.

FIG. 5 shows a diagram with the profile of the oscillating stroke amplitude A over the exciter frequency $f_N$ of the system mass of a compacting device according to the invention (for example FIG. 1), with a single natural frequency, set at about 70 Hz, and with a specific damping D1 for the curve K1. In this diagram, a sinusoidal exciter force with a constant exciter force amplitude over the entire range of the exciter frequency is provided. The damping D1 allows for the frictional losses and the energy losses of the oscillating system by the compaction energy delivered The curve K1 represents the known resonance curve. The exciter force is able to generate an amplitude of A=0.36 mm in the range of quite low frequencies. In the range of the natural frequency, the same exciter force generates an amplitude of A=1.8 mm, which corresponds to an amplitude amplification (resonance amplification) of Φ=5. If it were desired to achieve the same amplitude of 1.8 mm with lower exciter frequencies, for instance around 58 Hz, the value of the exciter force amplitude would in this case have to be increased approximately by a factor of 1.8. Two different methods of regulating the amplitude A according to a given value for a given natural frequency of 70 Hz are to be shown on the basis of FIG. 5:

In the case of a first method (which is similar to the method mentioned in the publication DE 44 34 679 A1, although the oscillating stroke amplitude A is not to be regulated there), the force excitation is performed by a directional unbalance vibrator that cannot be regulated with respect to its static moment and is intended to operate with a nominal exciter frequency of 63 Hz, the centrifugal forces then developed (the exciter force amplitude is set=100%) generating an amplitude of A=1.4 mm (point Q on the curve K1). With an increase in the exciter frequency from 63 Hz to 70 Hz, the amplitude is increased to A=1.8 mm (and with a reduction in the exciter frequency to 58 Hz, the amplitude could be lowered to A=1 mm). As is evident, this first method involves having to change, the exciter frequency for the purpose of changing the amplitude A. Conversely, the amplitude A changes automatically when the exciter frequency passes through a specific range.

In the case of a second method, the force excitation is generated by a linear motor that can be regulated in its exciter force amplitude, the exciter frequency of which is set to 63 Hz and the exciter force amplitude of which is set to 100%. The oscillating stroke amplitude that can be attained thereby is in this case likewise A=1.4 mm. However, here the changing of the amplitude A is achieved by changing the exciter force amplitude (a) while keeping the exciter frequency (of 63 Hz) constant. To be able to regulate the amplitude A to a value of A=1.8 mm, the exciter force amplitude (a) must be increased in such a way that a quite different resonance curve K2 is generated, the point of intersection with the 63 Hz line reaching the value of A=1.8 mm. For the purpose of setting an amplitude of A=1 mm at 63 Hz, a different type of resonance curve K3 must be generated by reducing the exciter force amplitude (a). It is evident that, unlike in the case of the first method, an amplitude A that can be given as desired can be achieved independently of the exciter frequency. At the same time, use of the second method also allows the exciter frequency to be changed as desired (also continuously) within a given frequency range according to a time function which can be given, and at the same time also allows amplitudes A that can be given as desired to be additionally generated. The second method is the one which is used in the case of the present invention. When the second method is used, the periodic exciter force does not necessarily have to be generated to follow a sine function. What is decisive for the generation of a specific amplitude A with a given damping D is the amount of energy supplied by means of the exciter device per oscillating period. The variation over time of the exciter force could in this case also follow a square function instead of a sine function, it being possible to conclude a substitute exciter force amplitude (a*) in the case of a sinusoidal profile of the exciter force from the amount of energy converted per period.

Figure 6:
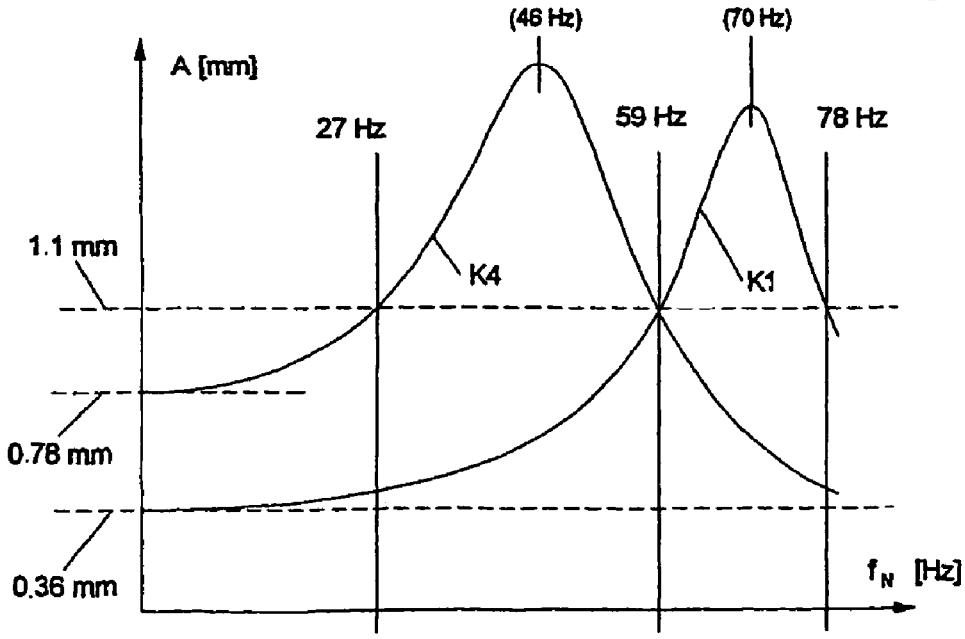
In FIG. 6, a diagram similar to that of FIG. 5 is shown, the advantage of an additional natural frequency of the oscillating system being explained.

FIG. 6 shows a diagram similar to that of FIG. 5, in which the curve K1 corresponds to the curve K1 shown in FIG. 5 and characterizes a mass-spring system which has a natural frequency at about 70 Hz. A second curve K4 represents the resonance curve of the same mass-spring system, with which however in this case the natural frequency is switched over to a different value of about 46 Hz (by changing the resulting spring constant of the system spring). The force excitation of the associated mass-spring system is to take place as in the case of the second method, described in FIG. 5, by generating the exciter force amplitude (a or a*) using a linear motor that can be regulated, it being intended for the force to which the exciter actuator is subjected to be regulated by a special activating device, it also being intended that the amount of energy to be converted is to be influenced, for regulating a given value for the amplitude A (on condition that there is a suitable measuring device for measuring the magnitude of A). In the case of the curve K4, an identical exciter force amplitude as in the case of K1 was assumed, but a doubled damping value D4 in comparison with D1. Because of the lower value of the spring constant, an amplitude of A=0.78 mm is attained even with a quite low exciter frequency. The diagram shows that, when the oscillating properties of the two curves are used over a range of the exciter frequency from 27 to 78 Hz, an oscillating stroke amplitude of 1.1 mm can be achieved. This means in comparison with the possibility provided by curve K1 alone an extension of that frequency range within which at least an equally large amplitude can be set. For the present invention, this phenomenon is used in that, in the case of a compacting operation, the exciter frequency, which in this case is identical to the compacting frequency, is passed through (in the case of the example of this diagram) from a value of 27 Hz to a value of 78 Hz, it being possible for the amplitude to be regulated to a value of A=1 mm by regulating the amount of exciter energy to be converted per period. In the case of a compacting operation, in practice the damping value D changes continuously from a higher value (D4) to a lower value (D1). While carrying out the compaction with the exciter frequency continuously increasing, at a certain frequency a switch is made over to the spring constant corresponding to the natural frequency of 70 Hz. If the natural frequency can be adjusted in more than one step, optimally continuously, the methods described can be further optimized, in that the natural frequency can likewise be adjusted along with the changed exciter frequency, the amplitude at the same time being regulated according to a given value for A. In the case of a method of this type, the given values for A could be achieved with much lower exciter energy in comparison with the oscillation excitation of a conventional type.

It is the case for all the drawings of FIGS. 1 to 4 that firm connections between two components are symbolically represented by dash-dotted lines.

What is claimed is:

1. A compacting device for compacting a granular material, comprising:

a vertically movable base plate;

a mold adapted to receive the granular material, the mold being positionable on the base plate;

a plurality of baffle bars disposed below the base plate, the baffle bars being stops for downward movement of the base plate;

a pressing plate disposed above the base plate, the pressing plate being adapted to subject an upper surface of the granular material in the mold to a permanent pressing force during compaction;

an oscillatory mass-spring system including:

a vibrating table disposed below the base plate, said vibrating table having a mass substantially defining a predominant mass of the mass-spring system, said vibrating table being excitable to produce vertical oscillating movement having a compaction frequency range, whereby said vibrating table impacts the base plate from below, and a system spring having a spring constant, the system spring being set hard at least for the downwardly directed movement of the vibratory table, the system spring storing and delivering a kinetic energy of the mass-spring system wherein at least one natural frequency of the mass-spring system is adjustable by a corresponding combination of system mass and spring constant of the system spring, the at least one natural frequency being in the range of the compaction frequency;

an exciter device having at least one exciter actuator, the at least one exciter actuator periodically generating an exciter force having an exciter energy for exciting the vibrating table; and a regulator regulating the oscillating movement by controlling the exciter energy transferred by the exciter device into the mass-spring system independently of the compaction frequency.

2. The compacting device as claimed in claim 1, wherein the spring element of the system spring is composed of steel or a low-damping elastomer material or is a liquid medium securely enclosed in a compression chamber.

3. The compacting device as claimed in claim 1, wherein the system spring includes:

an upper spring system having at least one upper spring element which is subjected to compression and which stores at least part of the kinetic energy of the system mass during upward oscillating movement and a lower spring system having at least one lower spring element which is subjected to compression and which stores the majority of the kinetic energy of the system mass during downward oscillating movement, the upper and lower spring systems each exerting a force on the system mass.

4. The compacting device as claimed in claim 3, wherein the upper spring system includes at least one upper-lying spring element, a part of the kinetic energy of the system mass during downward oscillating movement while a previous impact process is being carried out being stored by the upper-lying spring element, the spring forces of the upper-lying spring element being effective from above on the pallet.

5. The compacting device as claimed in claim 3, wherein the lower spring system includes an adjustable mechanical spring element comprising a leaf spring and an auxiliary motor drive, the leaf spring having a spring-effective spring length defined between a point of force introduction of an introduced force Fm on an upper surface of the leaf spring and a point of force introduction of a supported force Fa on a lower surface of the leaf spring, where Fa=Fm/2, the spring-effective spring length being adjustable by the auxiliary motor drive.

6. The compacting device as claimed in claim 1, wherein the spring element of the system spring is a hydraulic spring, said hydraulic spring being adjustable by changing a compressible spring volume in a compression chamber.

7. The compaction device of claim 1, wherein the regulator regulates a variable derived from the oscillating movement of one moving part of the group consisting of the vibrating table, the base plate and the mold.

8. The compacting device as claimed in claim 7, further comprising a measuring system for measuring the actual values of the physical variable.

9. The compacting device as claimed in claim 1, wherein the exciter actuator comprises an AC electrical linear motor with permanent-magnet excitation or an asynchronous motor having a fixed motor part and a linearly movable motor part, and the exciter actuator regulates a physical variable by apportioning the energy supplied or moved in an oscillating period.

10. The compacting device of claim 1, wherein the system spring comprises a plurality of spring elements.

11. The compacting device as claimed in claim 9, wherein for a three-phase AC motor, the exciter actuator also comprises a special activating device for the generation of specific and influenceable portions of exciter energy per oscillating period.

12. The compacting device as claimed in claim 11, wherein the following functions are alternatively or simultaneously executed by the special activating device for the electrical linear motors, the beginning and end of the development of the motor exciter force and the magnitude of the motor exciter force are determined or calculated by the special activating device once or twice within the oscillating period of 360° in time with a predetermined exciter frequency, for the purpose of controlling the phenomenon of the occurrence of the phase shifting angle y and the changing of the phase shifting angle y automatically occurring under the influence of certain parameters, a special algorithm is used by the special activating device, which has the effect that the measured value of the physical variable to be regulated or of the value derived from it by the control algorithm for the manipulated variable y for fixing the magnitude of the next portion of energy to be transferred in buffer-stored for a short time.

13. The compacting device as claimed in claim 1, wherein energy is extractable from the oscillatory system by delaying the oscillation process after an overshooting regulating process or by rapidly stopping the oscillation process.

14. The compacting device as claimed in claim 1, wherein at least one settable or set natural frequency of the mass-spring system is not greater than substantially 30% of the upper compacting frequency used for the pre-compaction or the main compaction or the at least one settable or set natural frequency of the mass-spring system is above a value of 30 Hz.

15. The compacting device as claimed in claim 1, wherein the exciter actuator is an electrical or hydraulic linear motor and the vibrating table is guided in its oscillating movement by a single central linear guide, to absorb horizontal forces on the vibrating table and to ensure a co-directed acceleration at all the parts of said vibrating table.

16. The compacting device as claimed in claim 1, further comprising at least one additional mass removably connected to the system mass by a hydraulically actuated component in a switching operation, the additional mass co-oscillating synchronously together with the system mass to adjust the natural frequency of the mass-spring system.

17. The compacting device of claim 1, wherein the base plate is a palette.

18. The compacting device as claimed in claim 1, wherein the spring constant of at least one of the spring elements is adjustable continuously or in steps.

19. The compacting device as claimed in claim 18, wherein the natural frequency of the mass-spring system is adjusted by adjusting the spring constant of the spring elements in steps or continuously while the exciter frequency passes through a range including at least one predetermined exciter frequency.

20. The compacting device as claimed in claim 1, further comprising a damping mass having mass which is at least 20 times greater than the system mass, the damping mass being connected to the system spring and being supported by at least one isolating spring against the foundation.

21. The compacting device of claim 7, wherein the exciter energy is controllable by the regulator in at least one of a working state consisting of idling the compacting device without granular material and without the pressing plate in action, compacting without the pressing plate acting on the granular material, and compacting with the pressing plate acting on the granular material.

22. The compacting device as claimed in claim 1, wherein the exciter actuator comprises an unbalance vibrator having a rotational speed which can be regulated, a physical variable of the upper or lower amplitude of the oscillating strokes of the vibrating table or of the oscillating stroke of the mold or a variable derived from the oscillating velocity or oscillating acceleration being regulated according to a predetermined value, wherein exciter energy transferred by the exciter device is extracted from the oscillatory mass-spring system by a damping device influenced by the regulator, the extracted energy being transferred by the oscillating movement of the mass-spring system.

23. The compacting device of claim 7, wherein the variable is one of the group consisting of an upper amplitude and a lower amplitude of the oscillating movement of the vibrating table, an oscillating velocity of the vibrating table, and an oscillating acceleration of the vibrating table.

24. The compacting device as claimed in claim 1, wherein the compacting device carries out compacting operations which are executed at least in a pre-compaction, in which the molded body cannot be brought into connection with the pressing plate.

25. The compacting device as claimed in claim 1, wherein the system spring of the vibrating table is set hard for both directions of oscillation.

26. The compacting device of claim 1, wherein the exciter actuator is one of the group consisting of an electrical linear motor, a hydraulic linear motor and an unbalance vibrator, the latter being adjustable with respect to its static moment and its resulting directed centrifugal force being at least twenty percent smaller than an accelerating force required on the system mass for carrying out oscillating stroke amplitudes with a maximum frequency.

27. The compacting device of claim 1, wherein a frequency of periodic generation of the exciter force and the exciter energy of the exciter device is regulated according to a frequency value.

28. The compacting device of claim 27, wherein the intended frequency value follows a time function.

29. The compacting device as claimed in claim 1, further comprising an additional spring system having at least one spring element which is subjected to bending, torsion or thrust and which stores at least part of the kinetic energy of the system mass during upward oscillating movement and the majority of the kinetic energy of the system mass during downward oscillating movement.

* * * * *